United States Patent [19]

Sizemore

[11] Patent Number: 5,071,019

[45] Date of Patent: Dec. 10, 1991

[54] LID-DRINKING STRAW ASSEMBLY

[76] Inventor: David W. Sizemore, 106 Ashwood Ct., Perryburg, Ohio 43551

[21] Appl. No.: 669,967

[22] Filed: Mar. 15, 1991

[51] Int. Cl.[5] ..... B65D 47/06

[52] U.S. Cl. ..... 220/709; 215/1 A; 215/229; 220/707

[58] Field of Search ..... 220/90.2, 90.4, 90.6, 220/254, 356; 215/1 A, 229

[56] References Cited

U.S. PATENT DOCUMENTS

| | | | |
|---|---|---|---|
| 2,948,453 | 8/1960 | Drown | 220/90.4 X |
| 3,106,312 | 10/1963 | Hitchcock | 220/90.4 |
| 4,415,097 | 11/1983 | Meins | 220/90.4 |
| 4,494,668 | 1/1985 | Lottick | 220/90.4 |
| 4,582,213 | 4/1986 | Park et al. | 220/90.2 |
| 4,586,625 | 5/1986 | Garrett | 220/266 |
| 4,703,873 | 11/1987 | Geren | 220/90.2 X |
| 4,714,173 | 12/1987 | Ruiz | 229/90.4 |
| 4,811,860 | 3/1989 | Sorenson et al. | |
| 4,830,204 | 5/1989 | Lin | |
| 4,911,315 | 3/1990 | Shrum | 220/90.2 X |
| 4,923,084 | 5/1990 | Forbes | |
| 4,948,009 | 8/1990 | Sawatani | 220/229 |
| 5,018,635 | 5/1991 | Whittaker | 220/90.2 |

*Primary Examiner*—Stephen Marcus
*Assistant Examiner*—Vanessa Caretto

[57] ABSTRACT

A lid-straw assembly installable on an opened beverage can to facilitate the process of drinking the liquid beverage from the can. The lid includes a peripheral rim wall that snaps down around the upper edge of the can to mount the lid on the can; the rim wall seals against leakage across the can-lid interface. A hollow drinking straw extends through the lid so that a portion of the straw is exposed for drinking purposes; a second portion of the straw extends downwardly into the can for extraction of liquid from the can.

7 Claims, 1 Drawing Sheet

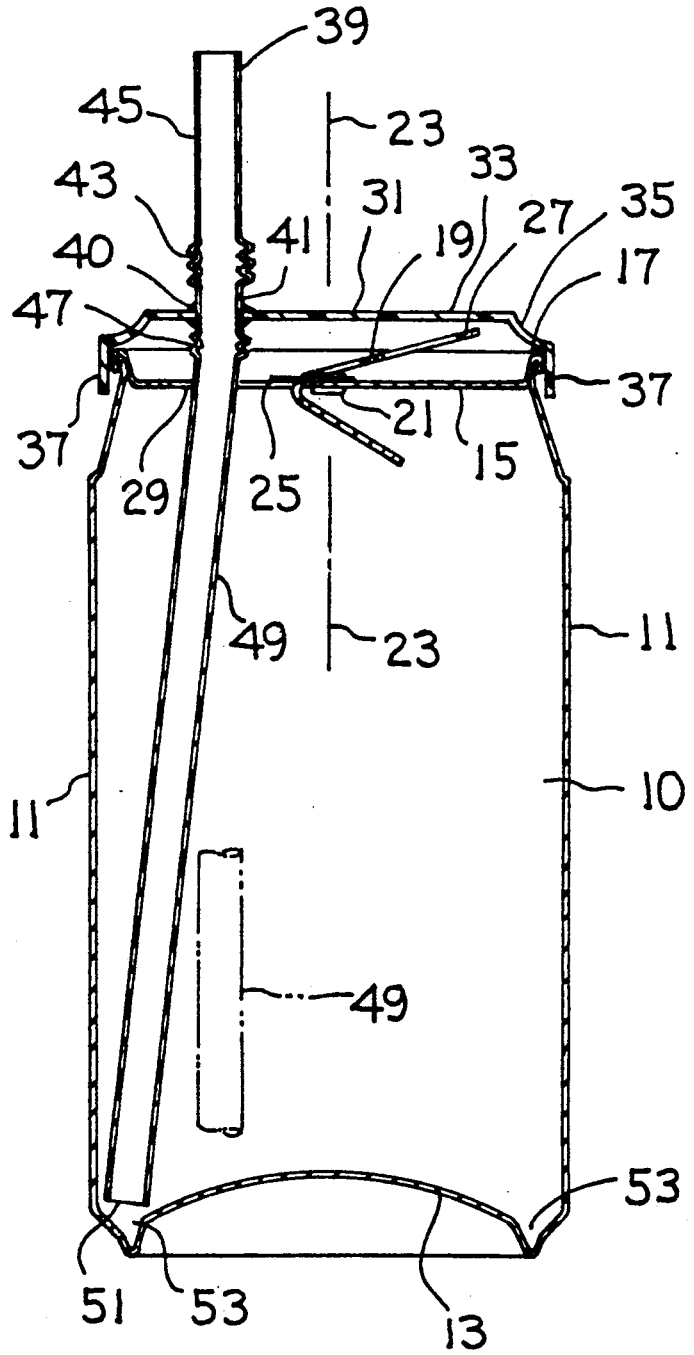
39
45
23
33
43
31
35
41
19
27
40
17
47
37
37
21
15
29
25
49
23
11
11
10
49
53
51
53
13

LID-DRINKING STRAW ASSEMBLY

BACKGROUND AND SUMMARY OF THE INVENTION

This invention relates to a lid-straw assembly installable on an opened beverage can to permit a person to drink the beverage through the straw, rather than through the opening in the top of the can. Use of a drinking straw makes it somewhat easier for the person to get his/her mouth into communication with the liquid, since the straw projects up from the can for easy access, whereas the can opening is recessed into the top wall of the can at some point around the can circumference. The person may not always be able to orient the can so the can opening faces the person's mouth; when a straw is present the orientation process is considerably simplified. Also, when a drinking straw is used the person can draw the liquid up through the straw without tipping the container, whereas when the person drinks directly through the can opening the can has to be at least partially overturned in order for the liquid to gravitate from the can into the person's mouth. When a person drinks directly from the can opening there is a possibility that some of the liquid will splash out of the opening onto the person's face or neck, in the event that the person overturns the can too far. Use of a drinking straw affixed to the can makes the drinking process somewhat more efficient and enjoyable, with less possibility for spillage.

U.S. Pat. No. 4,811,860 to C. Sorenson et al shows a hollow drinking straw attached to a lid for an open cup. Apparently the cup is of the disposable type, used for example in fast food restaurants for containing soft drinks; the cup is formed of paper or plastic, as indicated at column 1, line 60, of the patent specification.

The present invention is concerned with a lid-straw assembly usable on an opened beverage can. Commonly such beverage cans are formed of aluminum; the top wall of the can has a manually actuable tab structure affixed thereto by a rivet extending through the wall at its center point. When the tab structure is manually pulled it exerts a downward force on a weakened section of the top wall, such that the weakened section is deflected downwardly into the can to form an access opening. My invention utilizes that access opening as a clearance space to accommodate a drinking straw. The straw is carried on a circular lid that can be pushed down over the top wall of the can to mount the lid on the can. When the lid is mounted on the can the straw extends downwardly into the can. A section of the drinking straw projects upwardly from the lid for drinking purposes. The person places his/her mouth around the projecting portion of the hollow straw to draw liquid from the beverage can.

THE DRAWINGS

The single FIGURE is a cross sectional view of a beverage can having a lid-straw assembly of the present invention installed thereon.

DESCRIPTION OF A PREFERRED EMBODIMENT OF THE INVENTION

The drawing shows a generally conventional metal beverage can 10 of the type that is commonly used for containing carbonated soft drinks, e.g. soft drinks marketed under such trade names as Coca Cola, Pepsi-Cola or Seven Up. The can has an annular cylindrical side wall 11, bottom wall 13, and top wall 15. The can top wall is affixed to the can side wall by crimping an annular portion of the top wall around the upper edge of the side wall. The crimping operation causes the can top wall to be somewhat depressed below the plane of the annular crimped edge structure 17.

A metal tab structure 19 is attached to top wall 15 by a rivet 21 that is usually located on the central axis 23 of the can. Tab structure 19 has a left end portion 25 engageable with the upper surface of the can top wall, and a right end portion 27 that is manually liftable away from the can top wall 15, so that the end portion 25 can exert a downward force on wall 15. The can top wall is scored (weakened) so that manual operation of tab structure 19 deflects the weakened section of wall 15 downwardly into the can thereby forming an access opening 29 through wall 15.

My invention relates to a lid-straw assembly that can be installed on the conventional beverage can 10 to facilitate the drinking process. The assembly comprises a plastic lid element 31 that includes a circular disk 33, a concave annular wall 35 radiating downwardly and outwardly from the outer edge of disk 33, and a downwardly extending rim wall 37 extending axially from concave wall 35. Rim wall 37 is adapted to fit snugly around the top edge of can 10 so that any liquid escaping from the can through access opening 29 is trapped in the space between top wall 15 and the undersurface of lid 31. This protects the person's clothing from spilled liquids.

Concave wall 35 extends downwardly and outwardly from the plane of disk 33 so as to be seatable on the crimped edge structure 17, while disk 33 is spaced away from the can top wall 15. Tab structure 19 will ordinarily project a slight distance above the plane of edge structure 17; concave wall 35 acts as a spacer to let the lid fit snugly down onto the can without interference from tab structure 19.

As shown in the drawing, a hollow tubular straw 39 extends through a circular hole 40 in lid 31. The circular hole is located at a point approximately midway between the central axis 23 of the lid and rim wall 37, so that when the lid is pushed down onto the beverage can the lower end portion of the straw will automatically project through access opening 29. Straw 39 is preferably formed of plastic material; it may be affixed to lid 31 by any suitable adhesive applied at the joint between hole 40 and the outer surface of the straw.

Straw 39 comprises a first relatively short cylindrical section 41 extending through hole 40, a second corrugated section 43 located immediately above cylindrical section 41, a third rigid cylindrical section 45 extending upwardly from corrugated section 43, a fourth corrugated section 47 located immediately below cylindrical section 41, and a fifth elongated cylindrical section 49 extending downwardly from corrugated section 47. Tube (straw) 39 is preferably a hollow one piece plastic structure, as is lid 31. The lid and straw are adhesively attached together in a factory setting. Straw section 41 serves as the connection point between the straw and lid; section 41 is preferably only about one fourth inch long, so that corrugated sections 43 and 47 are located in near proximity to the attached portion of lid 31.

Each corrugated section of the straw acts as a hinge between the mounted section 41 and the respective rigid sections 45 and 49. Upper cylindrical section 45 can be placed in the person's mouth for drawing liquid out of can 10. The hinging action of corrugated section 43 enables straw section 45 to be angled relative to the can axis 23, such that the person can hold the beverage can in a range of different attitudes while still using the straw for drinking purposes.

The length of the elongated straw section 49 is slightly greater than the spacing between the can top wall 15 and the can bottom wall 13. Therefore, when lid 31 is placed on the beverage can, wall 13 deflects cylindrical section 49 of the straw laterally so that its lower open end 51 is located near the can side wall 11. Corrugated section 47 of the straw acts as a hinge to permit the desired lateral deflection of straw section 49.

During the process of drawing liquid out of can 10 through straw 39 the liquid level will gradually be lowered until the liquid is concentrated in the annular corner space 53 at the junction between bottom wall 13 and annular side wall 11. The deflectable nature of the straw causes the lower open end of the straw to be in a position for extracting most of the liquid.

The illustrated lid-straw assembly is somewhat similar to a lid-straw mechanism shown in aforementioned U.S. Pat. No. 4,811,860. However, the mechanism there shown lacks the corrugated straw sections 43 and 47 used herein. Also, in the arrangement of U.S. Pat. No. 4,811,860 the lid fits onto an associated cup so that the lid plane is essentially coincident with the upper edge of the cup. The structure shown in U.S. Pat. No. 4,811,860 therefore lacks the spacer feature provided by my annular wall 35.

The drawing necessarily shows a specific structural arrangement embodying my invention. It will be appreciated however that some changes and modifications can be made while still practicing the invention.

What is claimed is:

1. A lid-straw assembly for temporary installation on a beverage can, wherein the can has a top wall, an annular side wall, a bottom wall, and a manually actuable tab structure affixed to the top wall for exerting a force on the top wall to deflect a section of the top wall downwardly into the can to form an access opening: said lid-straw assembly comprising a plastic lid element having a circular opening therethrough for accommodation of a straw; said lid element comprising a circular disk, a concave annular wall radiating downwardly and outwardly from a peripheral edge of the disk to seat against an outer edge of the can top wall, and a downwardly extending rim wall extending from said concave annular wall to fit around an upper edge of the can; said straw being a hollow tubular structure comprising a first annular section extending through the circular opening in the lid element for fixedly attaching the straw to the lid element, a second corrugated annular section located immediately above the first section, a third rigid annular section extending upwardly from said second section for drinking purposes, a fourth corrugated annular section located immediately below the first section, and a fifth elongated rigid annular section extending downwardly from said fourth corrugated section; said fifth section of the straw having a lower open end in near proximity to the can bottom wall when the lid element is installed on the can.

2. The lid-straw assembly of claim 1, wherein the lid is of one-piece construction, and the straw is of one-piece construction.

3. The lid-straw assembly of claim 1, wherein said circular opening is located approximately midway between a central axis of the lid and the lid rim wall.

4. The lid-straw assembly of claim 1, wherein the fifth rigid straw section having a length which is greater than a height between the can top wall and the can bottom wall, whereby placement of the lid on the can causes the fifth rigid straw section to be deflected angularly around a connection point to the fourth corrugated section so that the lower open end of the fifth straw section is located near the annular side wall of the can.

5. The lid-straw assembly of claim 1, wherein said second corrugated section of the straw acts as a hinge to permit said third rigid straw section to be acutely angled to the first straw section.

6. The lid-straw assembly of claim 1, wherein said first straw section is a rigid cylindrical section having a length no greater than about one fourth inch.

7. The lid-straw assembly of claim 1, wherein said rim wall has a relatively snug continuous fit around the upper edge of the can so that any liquid escaping from the can through the access opening is trapped between the can top wall and an undersurface of the lid.

* * * * *